US005259406A

United States Patent [19]

Hofmann

[11] Patent Number: 5,259,406

[45] Date of Patent: Nov. 9, 1993

[54] APPARATUS FOR CLEANING A TOILET BRUSH

[76] Inventor: Hermann Hofmann, Riemannstrasse 1, 6336 Solms-Niederbiel, Fed. Rep. of Germany

[21] Appl. No.: 1,201

[22] Filed: Jan. 6, 1993

Related U.S. Application Data

[63] Continuation of Ser. No. 830,748, Feb. 7, 1992, abandoned, which is a continuation of Ser. No. 570,635, Aug. 22, 1990, abandoned.

[30] Foreign Application Priority Data

Sep. 5, 1989 [DE] Fed. Rep. of Germany ..... 3929463

[51] Int. Cl.[5] ..... B08B 3/02

[52] U.S. Cl. ..... 134/50; 134/57 R; 134/95.2; 134/95.3; 134/103.2; 134/200

[58] Field of Search ..... 134/900, 44, 50, 57 R, 134/143, 149, 153, 155, 199, 200, 95.2, 95.3, 98.1, 99.1, 103.2; 206/15.2, 15.3, 209, 209.1, 361, 362.2, 362.3; 15/38, 310

[56] References Cited

U.S. PATENT DOCUMENTS

| | | | |
|---|---|---|---|
| 1,899,495 | 2/1933 | Celaya | 134/200 X |
| 2,918,925 | 12/1959 | Dopler | 134/199 X |
| 2,994,330 | 8/1961 | Catlin et al. | 134/95 X |
| 3,034,519 | 5/1962 | Jacobs | 134/95 |
| 3,587,597 | 6/1971 | Courtney et al. | 134/95.2 |
| 3,601,135 | 8/1971 | Marlow et al. | 134/102 |
| 3,918,987 | 11/1975 | Kopfer | 134/95 |
| 3,982,296 | 9/1976 | Russo . | |
| 4,132,567 | 1/1979 | Blackwood | 134/153 X |
| 4,197,000 | 4/1980 | Blackwood | 134/99 X |
| 4,456,022 | 6/1984 | Roberts | 134/153 X |
| 4,836,702 | 6/1989 | Allen . | |

FOREIGN PATENT DOCUMENTS

| | | | |
|---|---|---|---|
| 332828 | 3/1920 | Fed. Rep. of Germany . | |
| 2951994 | 7/1981 | Fed. Rep. of Germany . | |
| 3741480 | 6/1989 | Fed. Rep. of Germany . | |
| 2425833 | 1/1980 | France | 134/44 |
| 363659 | 10/1938 | Italy | 134/153 |
| 74489 | 10/1916 | Sweden | 134/199 |
| 270195 | 2/1946 | Switzerland . | |
| 0645120 | 1/1979 | U.S.S.R. | 134/199 |
| 820919 | 4/1981 | U.S.S.R. | 134/95 |
| WO83/02549 | 8/1983 | World Int. Prop. O. . | |

*Primary Examiner*—Philip R. Coe
*Attorney, Agent, or Firm*—Keck, Mahin & Cate

[57] ABSTRACT

Apparatus for cleaning a toilet brush includes a splash proof housing, which surrounds the toilet brush and has a bottom provided with an outlet for spent water, and a supply line leading to the housing. To permit simple, reliable and effective cleaning of the toilet brush, nozzles are provided in the housing, which are directed toward the toilet brush.

2 Claims, 1 Drawing Sheet

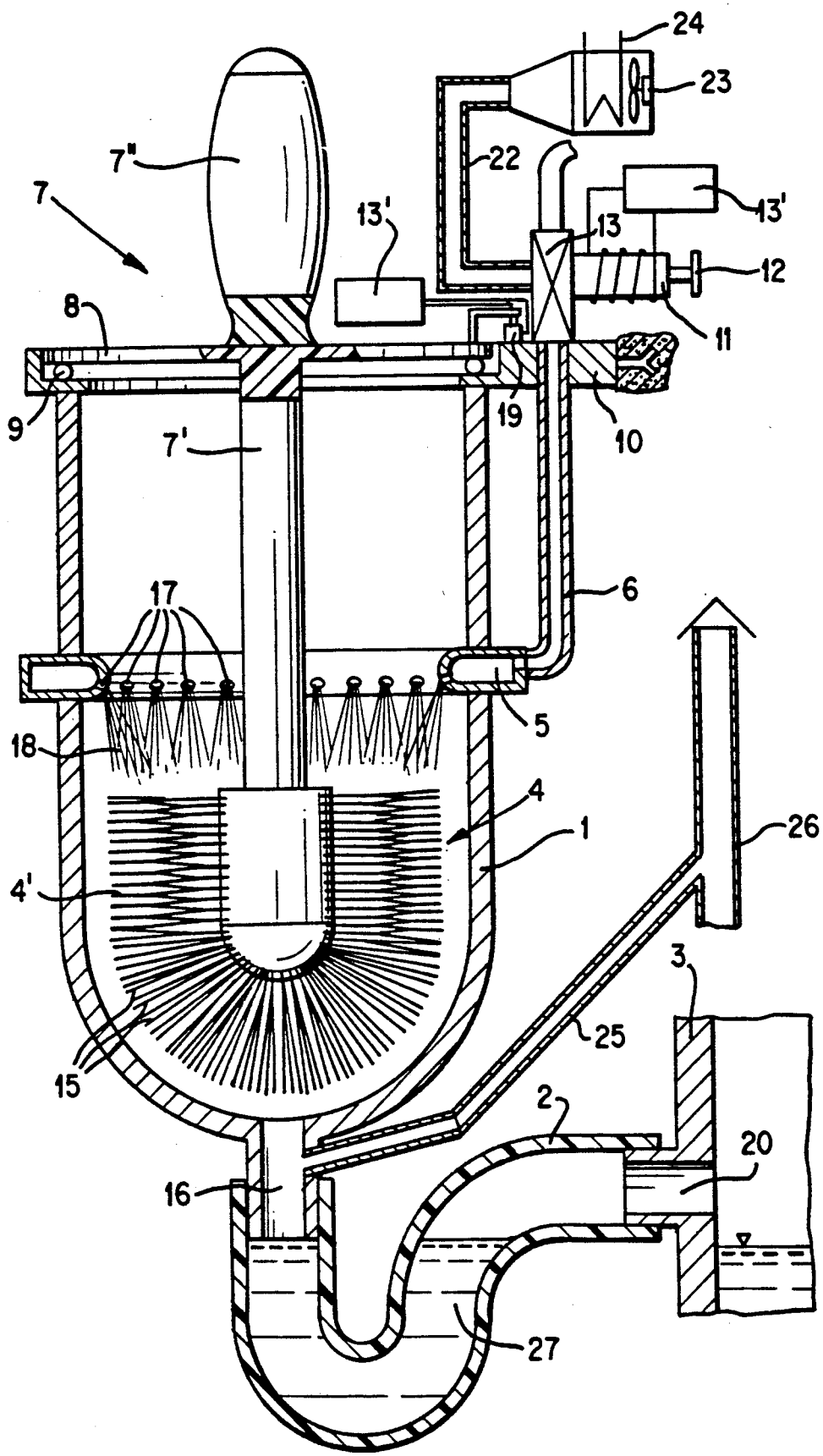
24
23
22
7"
7
13'
13
13'
12
8
11
9
19
10
7'
6
17
5
18
4
1
26
4'
3
25
15
2
20
16
27

APPARATUS FOR CLEANING A TOILET BRUSH

This is a continuation of application Ser. No. 07/830,748, filed Feb. 7, 1992, and now abandoned, which is a continuation of application Ser. No. 07/570,635, filed Aug. 22, 1990, and now abandoned.

BACKGROUND OF THE INVENTION

1. Field of the Invention

This invention relates to an apparatus for cleaning a toilet brush comprising a splash-waterproof housing, which surrounds the toilet brush and has a bottom provided with an outlet for spent water, and a supply line leading to the housing.

2. Description of the Prior Art

Toilet brushes are indispensable for human hygiene and must continually be cleaned. For such cleaning it has previously been necessary to hold and reciprocate the toilet brush in the water stream of a water closet, which for that purpose is flushed several times. In most cases the result of such cleaning is not satisfactory and the brush is discarded after a relatively short time of use. Besides, a remainder of unhygienic water will remain in the bowl in which the brush is kept and that dirty water is often carried by the brush onto the seat of the toilet.

An apparatus for cleaning toilet brushes of the kind described first hereinbefore is known from German Patent Specification 332,828. The known apparatus comprises a water tank, which is provided with an overflow and is connected to a scavenging line through which fresh water can be supplied to the water tank from below from time to time and, as a result, the brush held in the tank will always be kept clean. Scavenging water may be supplied from a separate cistern. The brush can simply be inserted into or hung in the water tank or can be fixed therein by other means and the water tank is surrounded by a second container for receiving the overflowing water, which is then delivered via a separate line. In the known apparatus the toilet brush is always immersed in water so that the cleaning action is not satisfactory.

SUMMARY OF THE INVENTION

It is an object of the invention to provide for the cleaning of toilet brushes an apparatus which is of the kind described first hereinbefore and can be used for a simple, reliable and more effective cleaning of the toilet brush.

That object is accomplished in accordance with the invention in that nozzles are provided, which are directed toward the toilet brush and serve to spray cleaning water onto the brush.

The resulting apparatus constitutes a self-cleaning scavenging device. Water is discharged from the nozzles onto the bristles of the brush and the soiled water is delivered to the water closet or to the drain. The application of the present invention will result in a saving of water and will reduce the amount of sewage to be disposed. Besides, the useful life of the brushes will be prolonged and the hygiene will be improved.

Desirable further features of the invention are defined in the dependent claims.

A plurality of nozzles may be provided in a nozzle body, which surrounds the toilet brush. That nozzle body desirably defines an annular cavity.

A siphon may be connected to the outlet for spent water.

The supply line leading to the nozzles desirably includes an operable valve. That valve may be operated by hand and/or by an actuator, such as a solenoid. The actuator may be controlled by a switch, preferably a limit switch. That limit switch is desirably operable by means of the toilet brush. In a desirable arrangement the limit switch is adapted to be mechanically actuated by the toilet brush as it is placed on the housing. In that case the placing of the toilet brush onto the housing will actuate the limit switch so that the cleaning operation will automatically be initiated.

The cleaning effect can be improved by the provision of a plurality of nozzle bodies, which are arranged one over the other.

Glass, plastic or ceramics are particularly suitable as materials from which the parts of the apparatus are made.

A fresh-air pipe is preferably provided through which fresh air can be supplied to the toilet brush through nozzles directed toward the brush. In that case the brush can be dried by air blasts after the scavenging or cleaning operation. By the air blasts directed toward the nozzles, any drops of water left on the brush will be blown off and the space in the housing around the brush will be dried so that the chance for a survival of bacteria will be reduced and the hygiene will thus be improved.

The fresh-air may be connected to an air supply line via a valve which is operable by hand and/or by an actuator, preferably a solenoid. In that case the fresh air is directed to the brush by the same nozzles as the cleaning water so that the water supply line and the nozzles will be dried by the fresh air. Besides, the need for a separate fresh-air line is eliminated in part and there is no need for separate air nozzles.

The valve is preferably a three-way valve through which water or fresh air can selectively be supplied to the toilet brush. The three-way valve is first moved to the position for a supply of water and the brush is then sprayed with water before the three-way valve is moved to the position in which fresh air is supplied and the brush is then dried by air blasts.

A time-limit relay is desirably provided for resetting the valve, particularly the three-way valve. When fresh air has been supplied for a time which is determined by the time-limit relay, the three-way valve is moved to the position for a supply of water.

A heater preferably consisting of a coiled heating resistor may be disposed in the fresh-air pipe. In that case, warm air will be supplied so that the drying action will be improved.

A waste-air pipe is desirably provided, which is installed in the housing or branches from the outlet. The waste-air pipe preferably branches at a point which precedes the siphon in the direction of flow so that the stream of waste air escaping from the housing cannot flow through the liquid kept in the drain pipe but is compelled to flow through the waste-air pipe. In accordance with a further desirable feature the air stream is generated by a fan, which is installed in the fresh-air pipe and/or the waste air pipe.

BRIEF DESCRIPTION OF THE DRAWING

The single FIGURE of the drawing is a longitudinal sectional view showing an illustrative embodiment of the invention.

DETAILED DESCRIPTION OF THE PREFERRED EMBODIMENT

The apparatus for cleaning toilet brushes shown in the single FIGURE of the drawing comprises a splash-waterproof housing 1, which surrounds the toilet brush 7 and is provided with nozzles 17, which are directed toward the toilet brush 7, specifically toward the bristles 15 of said brush. The bottom of the housing 1 is provided with an outlet 16 for spent water. That outlet is succeeded by a siphon 2, from which the spent water flows into the drain pipe 20, which is provided with a mounting flange 3. The bristles of the brush are connected to the bristle body 4 disposed at the bottom end of the stem 7' of brush 7, and which include bristles 4' approximately perpendicular to the stem of the brush as is well known for cleaning the sides of a toilet bowl.

The nozzles 17 are provided in a nozzle body 5, which surrounds the toilet brush and defines an annular cavity. The nozzle body 5 and the nozzles 17 are disposed slightly above the brush head 4 disposed at the bottom end of the toilet brush 7 so that the nozzles 17 will spray water on the bristles 15 from above. The nozzles 17 are downwardly inclined. Nozzles may be provided in a plurality of rows. The nozzles 17 are regularly distributed around the periphery of the nozzle body 5, which defines an annular cavity. Sharp jets of water 18 are discharged from the nozzles 17 onto the bristles 15, which are secured to the brush head 4 provided at the bottom end of the toilet brush 7. The water which has flown over the bristles 15 flows through the outlet 16 and the siphon 2 into the drain pipe 20.

The supply line 6 leading to the annular cavity of the nozzle body 5 provided with the nozzles 17 contains an operable valve 13, which is mounted on a flange 10 that is joined to the housing 1. The supply line 6 extends through the flange 10. The valve 13 is selectively operable by the solenoid coil 11 or by hand via the stem 12 so that the valve 13 can selectively be opened and closed by hand and by a control signal.

The housing 1 is provided at its top with an opening, which is adapted to be covered by a cover 8, which is fixed to the to the top end of the stem 7' of the toilet brush 7 just below the handle 7''. A seal 9 is provided on that side of the cover 8 which faces the opening and said seal rests on the rim of the opening to provide a sealing effect. The cover 8 has a lateral projection, which is adapted to operate a switch 19, which is mounted on the housing flange 10 and serves to control the valve 13. When the brush 7 has been inserted into the housing (bowl) 1, the switch 19 is operated to energize the solenoid coil 11 so that the valve 13 is opened. The switch 19 may be connected to a timer 13' for effecting a certain delay of time so that the valve 13 will be opened in that case only after an interval of time which is predetermined by means of the timer. The timer may be adjustable to vary the time delay in dependence on the requirements. When the valve 13 has been opened, water flows through the supply line 6 into the annular cavity 5 and further through the nozzles 17 onto the bristles 15. The valve 13 is preferably mounted on the flange 10, which may be used to mount the entire apparatus on the wall. A plurality of nozzle bodies 5 may be provided one over the other.

A fresh-air pipe 22 leads to the valve 13 and can be used to supply fresh air to the toilet brush through nozzles 17 directed to said brush. When the toilet brush has been cleaned with water, the fresh-air fan 23 which is installed in the fresh-air pipe 22 is turned on by hand or automatically. A coiled heating resistor 24 is disposed behind the fresh-air fan 23 in the direction of flow and serves to heat the fresh air before it is delivered in the fresh-air pipe 22 to the valve 13. The valve 13 consists of a three-way valve. During a supply of fresh air the flow of water through the three-way valve 13 is shut off. Fresh air is supplied through the supply line 6 and the nozzle body 5 to the nozzles 17 and through the latter is blown onto the brush bristles 15 of the brush 7 and impinges on the bristles 15 in such a direction that any water on the bristles 15 will drop and the remaining residual moisture will be evaporated. The waste air is then discharged via the waste-air pipe 25 and a ventilating pipe 26 into the open air, e.g., through a line which opens on the roof of the housing. In an alternative arrangement, not shown, the waste air is supplied to the drain pipe 3, which is provided with a vent.

The waste-air pipe 25 branches from the outlet 16 at a point which precedes the siphon 2 in the direction of flow so that the stream of waste air cannot flow to the drain pipe 20 through the liquid 27 which is kept in the siphon but the waste air is compelled to flow through the waste-air pipe 25.

A time-limit relay may be provided. The valve, specifically the three-way valve, can be moved to its initial position by a manual actuator or automatically after a time which is determined by such time-limit relay, which can be adjusted to a desired time delay. That time is so determined that it is sufficient for the drying of the brush. In its initial position the three-way valve shuts off the flow of fresh air.

An (additional) fan, which is not shown in the drawing, may be installed in the waste-air pipe 25. This may particularly be desirable if air-exhausting means or a waste-air fan is anyway provided in the toilet room. It is apparent that the air stream may be generated as a stream of compressed air or by suction or in both modes.

I claim:

1. An apparatus for cleaning a toilet brush comprising:

a splashproof housing for receiving a brush, the housing having a bottom provided with an outlet for spent water;

a water supply line leading to the housing;

nozzles in the housing provided in a nozzle body positioned to surround the brush and connected with the supply line for spraying water onto the brush; and a valve installed in the supply line, having an actuator operable by a limit switch connected between the brush and the housing so as to open the valve when the brush is placed in the housing;

wherein the brush has a cover having a projection for operating the switch controlling the valve supplying water to the supply line, the switch being mounted on the housing.

2. An apparatus according to claim 1 further comprising a fresh air pipe for supplying fresh air to the brush through said nozzles.

* * * * *